US009443393B2

(12) United States Patent
Johnson et al.

(10) Patent No.: US 9,443,393 B2
(45) **Date of Patent: *Sep. 13, 2016**

(54) MULTI-SITE TOURNAMENT GAMING METHOD AND SYSTEM

(71) Applicant: EVERI GAMES INC., Austin, TX (US)

(72) Inventors: Bradley W. Johnson, Austin, TX (US); Linda Trinh, Austin, TX (US); Galen Svanas, Austin, TX (US); John J. Carpenter, Austin, TX (US); J P Cody, Austin, TX (US)

(73) Assignee: EVERI GAMES INC., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/171,301

(22) Filed: Feb. 3, 2014

(65) Prior Publication Data

US 2014/0148250 A1 May 29, 2014

Related U.S. Application Data

(63) Continuation of application No. 13/606,958, filed on Sep. 7, 2012, now Pat. No. 8,702,499, which is a continuation-in-part of application No. 13/239,171, filed on Sep. 21, 2011, now Pat. No. 8,602,877.

(60) Provisional application No. 61/388,598, filed on Sep. 30, 2010, provisional application No. 61/406,019, filed on Oct. 22, 2010.

(51) Int. Cl.
*G07F 17/32* (2006.01)

(52) U.S. Cl.
CPC ..... *G07F 17/3276* (2013.01)

(58) Field of Classification Search
CPC ..... G07F 17/32
USPC ..... 463/16, 20, 25, 29, 42
See application file for complete search history.

(56) References Cited

U.S. PATENT DOCUMENTS

2007/0167226 A1* 7/2007 Kelly ..... G07F 17/32 463/29

* cited by examiner

*Primary Examiner* — Omkar Deodhar
(74) *Attorney, Agent, or Firm* — Nathan Calvert, Esq.; Russell D. Culbertson, Esq.; J P Cody, Esq.

(57) ABSTRACT

A multi-site tournament gaming system and method are disclosed wherein multiple casino operators are engaged to initiate a series of player qualifying events and to hold a multi-session tournament of the qualified players to determine the site winners; and, a final tournament is operated wherein the site winners are provided prizes and compete to be named the ultimate champion.

16 Claims, 9 Drawing Sheets

501

601

701

801

901

MULTI-SITE TOURNAMENT GAMING METHOD AND SYSTEM

CROSS-REFERENCE TO RELATED APPLICATIONS

This application is a continuation of U.S. application Ser. No. 13/606,958, filed Sep. 7, 2012, and entitled "Multi-Site Tournament Gaming Method and System," which application is a continuation-in-part of U.S. application Ser. No. 13/239,171, filed Sep. 21, 2011 and entitled "Tournament Game, Gaming Machine, Gaming System and Method With a Player-Interactive Bonus Feature", which claims the benefit, under 35 U.S.C. §119(e), of U.S. Provisional Application No. 61/388,598 filed Sep. 30, 2010, and entitled "Tournament Game, Gaming Machine, Gaming System and Method With a Player-Interactive Bonus Feature," and of U.S. Provisional Application No. 61/406,019 filed Oct. 22, 2010, having the same title. The entire content of each of these applications are incorporated herein by this reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all rights of copyright whatsoever.

FIELD OF THE INVENTION

This invention relates generally to games, gaming devices and systems, and methods used to provide tournaments on gaming machines, and, more particularly, to wagering games, gaming devices and systems and methods wherein multiple tournaments are initiated at multiple sites to determine winners at the respective sites and the winners are made eligible to compete in a subsequent tournament at an additional site to determine an ultimate winner.

BACKGROUND

Various tournament gaming systems have been developed to provide various formats and graphic presentations for conducting tournaments and presenting game results. There continues to be a need for methods and systems which may offer increased excitement and opportunities for players in tournament gaming systems.

SUMMARY OF THE INVENTION

In accordance with one or more embodiments of the invention, multi-site tournament gaming systems and methods are provided wherein multiple multi-session tournaments may be initiated at various sites to generate respective winners at the various sites who thereafter may become eligible to compete in one or more additional tournament sessions at additional sites until an ultimate winner is determined. The system establishes a set of pre-qualifying events to generate a list of qualified players at each of the enrolled gaming facilities. It also schedules one or more dates to conduct an in-casino championship tournament at each of the enrolled gaming facilities wherein the qualified players from the respective lists compete for one or more awards including an opportunity to advance to one or more multi-site tournaments. Further, it schedules one or more dates and locations to conduct the one or more multi-site tournaments. Preferred versions establish provide series of social media portals, for each casino or site, whereby information about the multi-site tournament, pre-qualifying events, enrolled facilities, and qualified players may be published and disseminated to players and site personnel.

These and other features of the invention will be apparent from the following description of the preferred embodiments, considered along with the accompanying drawings.

DETAILED DESCRIPTION OF PREFERRED EMBODIMENTS

Figure 1:
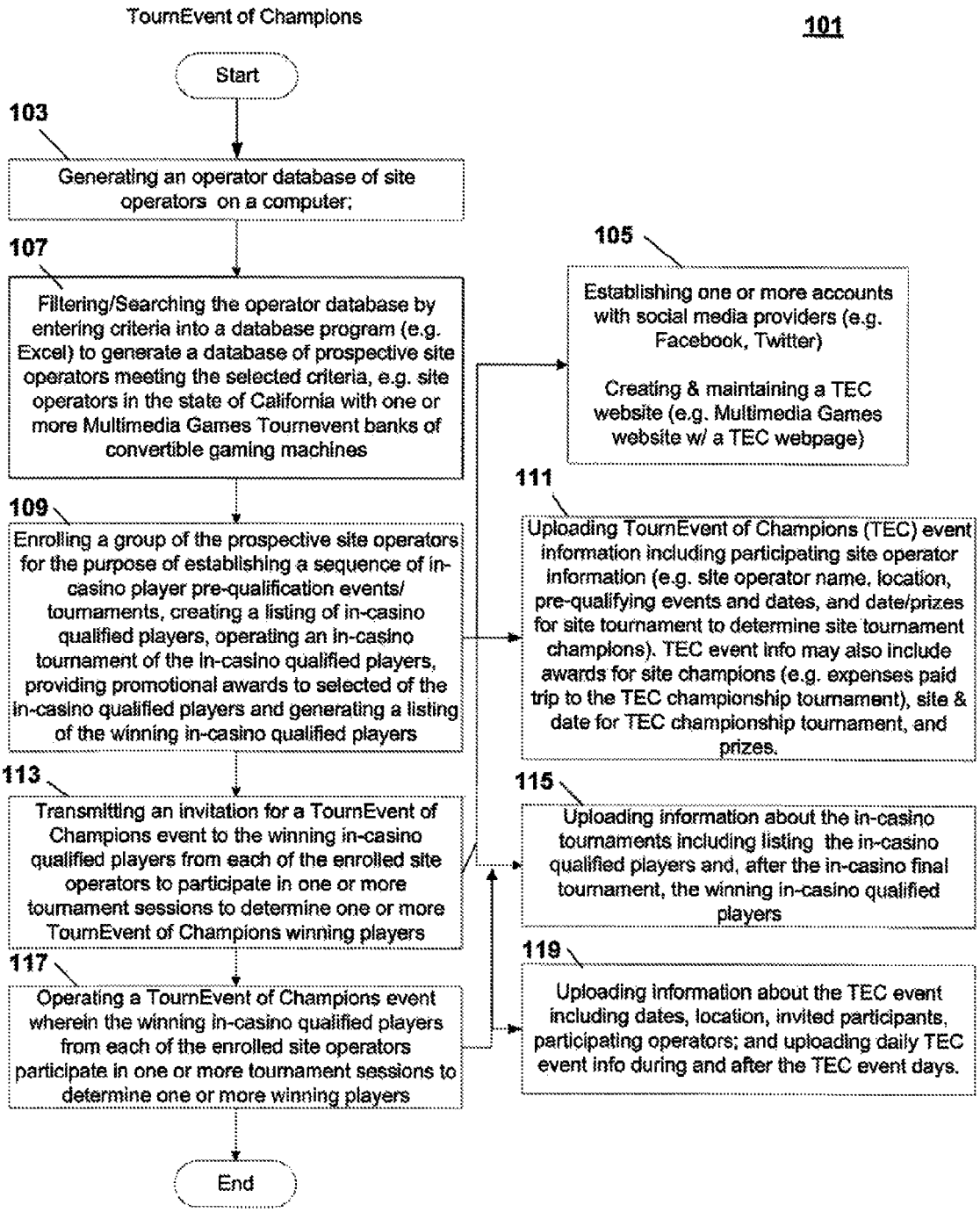
FIG. 1 illustrates an example flowchart of a process for producing a multi-site tournament on a gaming system in accordance with one or more embodiments.

Referring to FIG. 1, example multi-site tournament flowchart 101 is shown of a process for producing a multi-site tournament on a gaming system in accordance with one or more embodiments. After planning the steps for implementing the multi-site tournament (e.g. the TournEvent of Champions (TEC)) including the proposed participants and sequence of events to culminate in crowning a winner of the TEC, the process may be initiated by generating or accessing a casino operator database on a computer through a user interface, step 103, such as by a multi site tournament (TEC) coordinator, e.g. Multimedia Games, the gaming manufacturer of the TournEvent tournament gaming system. The casino operator database may include the casino site locations and whether or not pre-determined gaming equipment is installed at respective of the locations. For example, each of the site locations participating in the multi-site tournament may be required to utilize the same tournament gaming equipment, such as the Multimedia TournEvent gaming system (see FIG. 3-4); therefore, the database may include whether or not the Multimedia TournEvent gaming system is installed. And while it may be desirable to have the same tournament equipment, it may not be required, and so there may be an entry in the database indicating what if any type of tournament gaming system is installed at respective of the locations. If there is a minimum number of gaming machines required to be connected to the TournEvent gaming system, then that information may also be entered.

In parallel or in sequence with either the planning stage or database step 103, the TEC coordinator may create one or more accounts with one or more social media providers (e.g. Facebook, Twitter) and/or create one or more TEC webpages, such as at Multimedia Games website, or create an independent TEC website (e.g. www.TournEvent_of_Champions.com), step 105. On the webpages, for example, a homepage may include some information about an upcoming TEC championship event such as the date, location, and awards; another page may include dates for qualifying; another page may include tournament rules; and another page may include social media and other connections available to receive or obtain information about the TEC events and participants. Each of the pages may also include logos and names of the participating casinos. See FIG. 5-8. Additionally, one or more of the webpages may include steps and entries for an operator to enroll in a selected multi-site tournament.

Next, the operator database may be filtered or searched by entering criteria into a connected database program (e.g. Excel) to generate a database of prospective site operators meeting the selected criteria for participating in the TEC multi-site tournament, e.g. site operators in the state of California with one or more installed Multimedia Gaines TournEvent gaming systems, step 107. From the filtered database, the tournament coordinator may transmit the proposed TEC sequence of events, such as via electronic or physical mail, and enroll each of the identified casino operators electing to participate, step 109 either directly or by providing each identified casino operator an access button or active element in an electronic mail or similar artifice such that the recipient may select the access button which points to the initial entry point (a website portal) on the enrollment webpage of TEC website 203. The TEC sequence of events may be provided from a printout produced from a project file generated on a conventional project management program on the computer by the tournament coordinator and identifying milestones for each participating site operator to: a) advertise and implement a sequence of in-casino player pre-qualification events, such as mini-tournaments, and/or to reward players for achieving a sufficient number of player points on any or selected of the casino operator's gaming machines, e.g. Multimedia Games gaming machines; b) generate a list of in-casino qualified players (e.g. 300 qualified site players) to participate in a series of in-casino playoff tournaments, and c) conduct the in-casino playoff tournament in conjunction with the multi-site tournament coordinator to determine one or more site winners (the winning in-casino qualified players) for advancement to the TEC championship tournament (or to a first multi-site tier of the TEC championship tournament in the case where there are one or more multi-site TEC tournaments for players to compete and advance to one or more subsequent multi-site tournaments culminating in the TEC championship tournament). When enrolling such as through the enrollment pages of TEC website 203, an enrollee/operator may progress through a series of menus and entries such as may be programmed by or through the TEC coordinator on a TEC server connected to TEC website 203) to enroll one or more casino facilities, enter a proposed date or dates to conduct the in-casino playoff tournament, accept the terms and conditions for participation which may include agreeing to generate and provide a list of a predetermined minimum (and possibly a maximum) number of in-casino qualified players to participate in the in-casino championship tournament and may further include submission of an enrollment fee.

Once enrolled, each casino operator may transmit information to the TEC coordinator about the pre-qualifying events and dates and prizes and be able to add a webpage to the TOC website that is specific to the casino operator and/or casino whereon the casino operator may include qualifying dates and/or qualifying events or activities, such as winning in a pre-tournament event or obtaining a threshold number of player points during a given time period. See FIGS. 5-9. The TEC coordinator may also provide each participating operator with a turnkey marketing package which may include large, movie style stand-tees or meter boards for setup at the entrance to the facility, posters which may be hung at various locations, giant props and video advertisement such as may be placed on or about the tournament gaming machine banks, additional topper signage that may be displayed on various gaming machines, such as the sponsoring manufacturer's gaming machines, table tents that may be placed on the various bars and tables of the facility, a predetermined number of qualified player cards such as laminated golden tickets with the TEC championship logo, and portal connections to the TEC website and social media sites for transmitting and posting player, facility, and event information.

Figure 3:
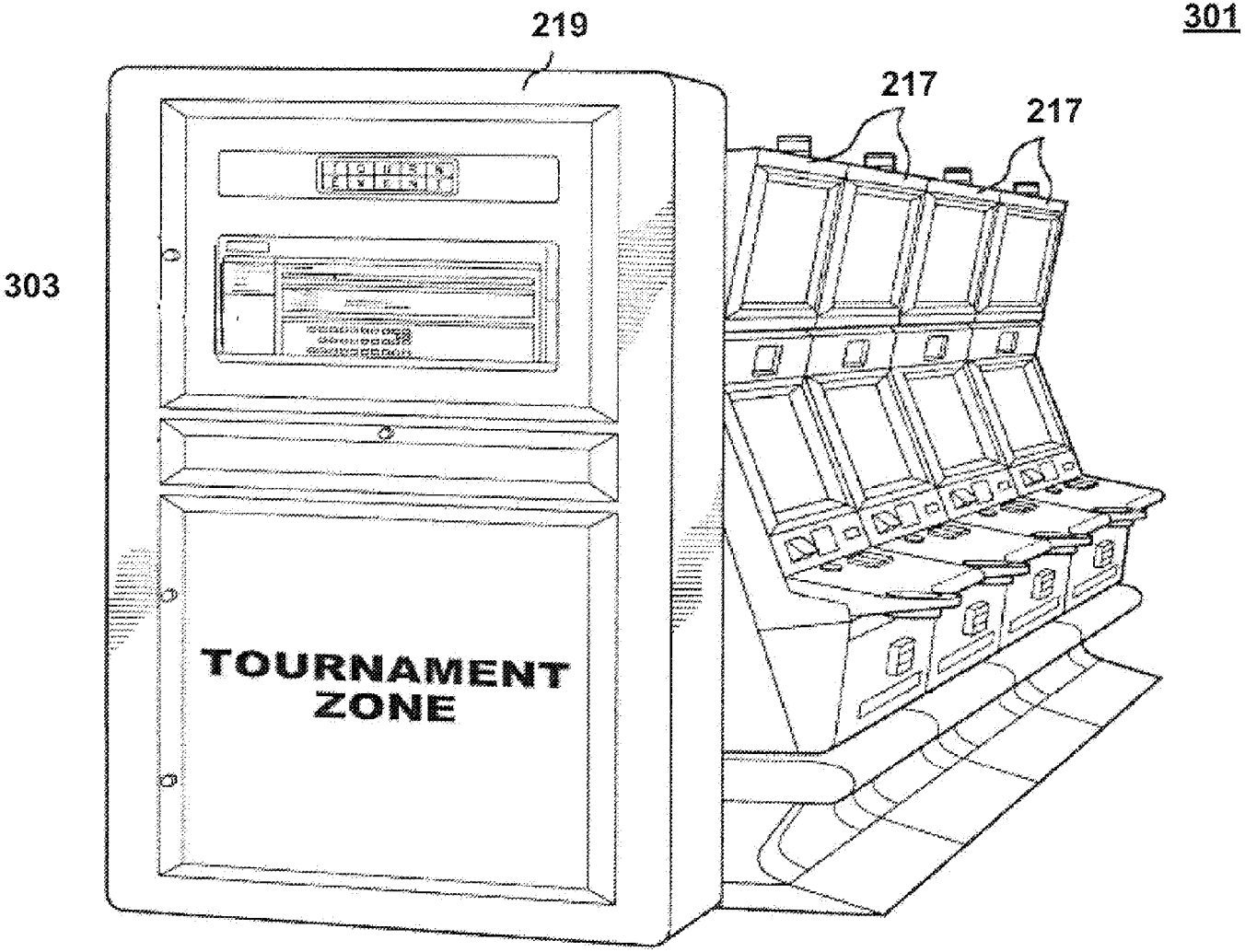
FIG. 3 illustrates an example tournament game system shown with a control center server controlling a bank of gaming machines, in accordance with one or more embodiments.

After the pre-qualifying events are held by respective casino operators, the respective operators may generate a qualified player database and present qualified players with one or more awards. The qualified player database may be input to an in-casino tournament server, such as shown in FIG. 3, through which the in-casino playoff tournament may be operated, such as by scheduling respective of the qualified players in tournament sessions to determine session winners, and then to schedule session winners in one or more further sessions until one or more in-casino champions are determined.

As each of the milestones are accomplished, the respective site operators may transmit the listing of the qualified players, on-site tournament leader board information, and finally, the list of winning site players to the TEC coordinator. Responsive to the data listings received, the TEC coordinator may post the information on the TEC website and on the various social media through its account to provide players and spectators an opportunity to read, disseminate, and share the excitement by receiving information about the site operators, the players and ongoing tournament information, steps 111 and 115.

Figure 4:
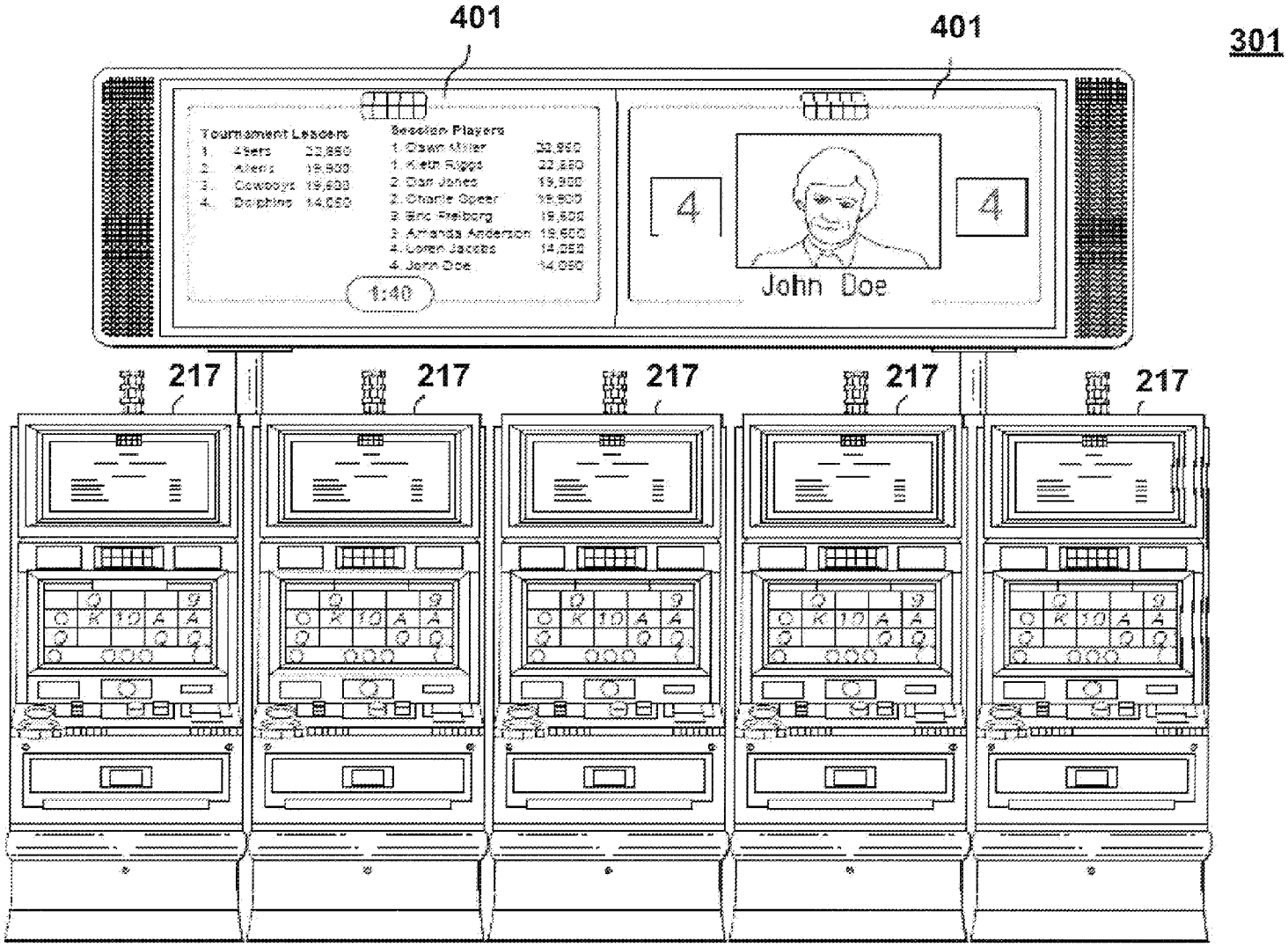
FIG. 4 illustrates an example tournament game system and a connected overhead display showing an example tournament snapshot in accordance with one or more embodiments.
Figure 5:
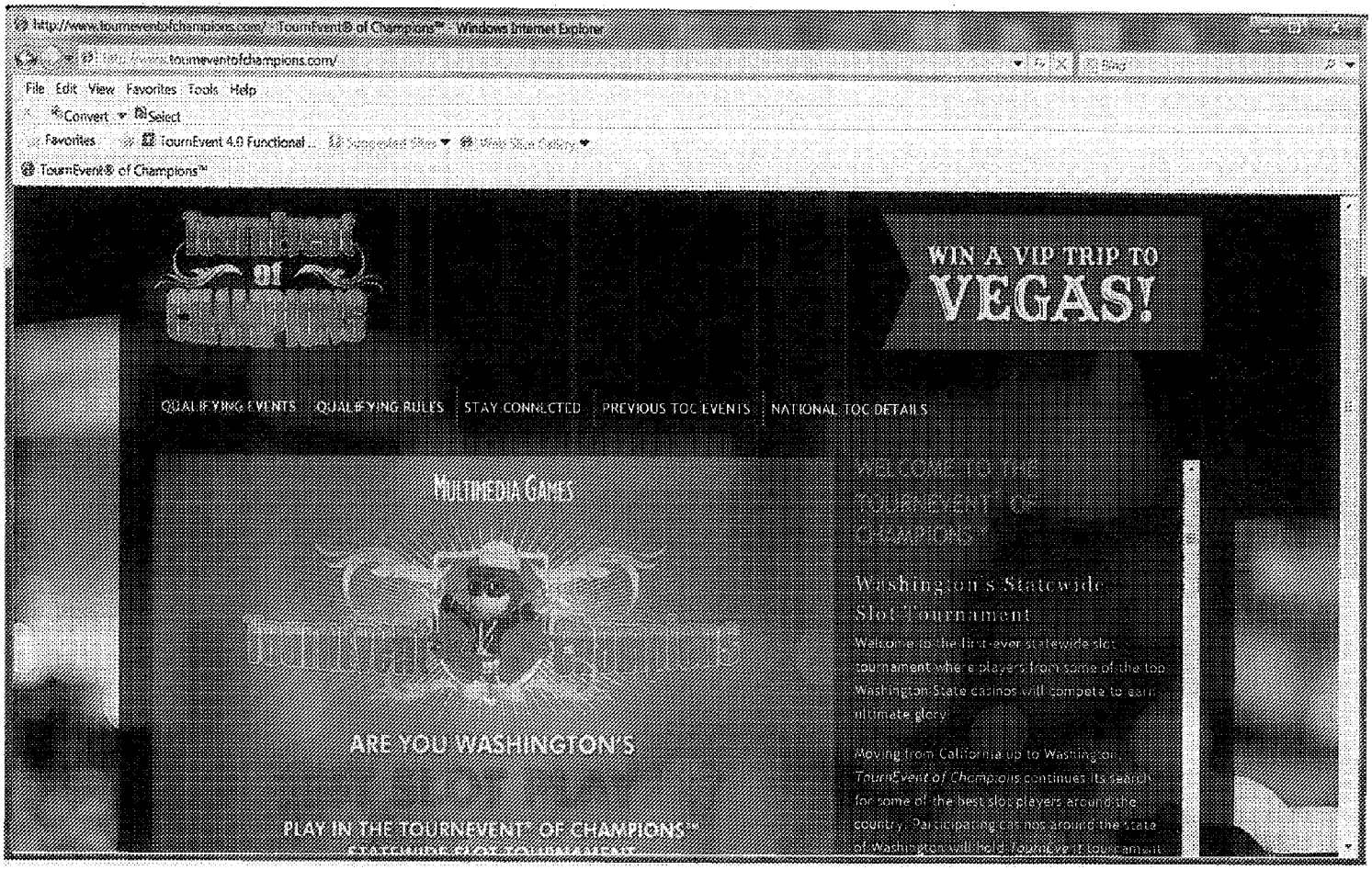
FIG. 5 is an example webpage (homepage) of a TournEvent of Champions (TEC) website wherein a listing of the upcoming schedule for a multi-site TEC tournament series of events may be build and include a menu through which a viewer may access the published information.
Figure 6:
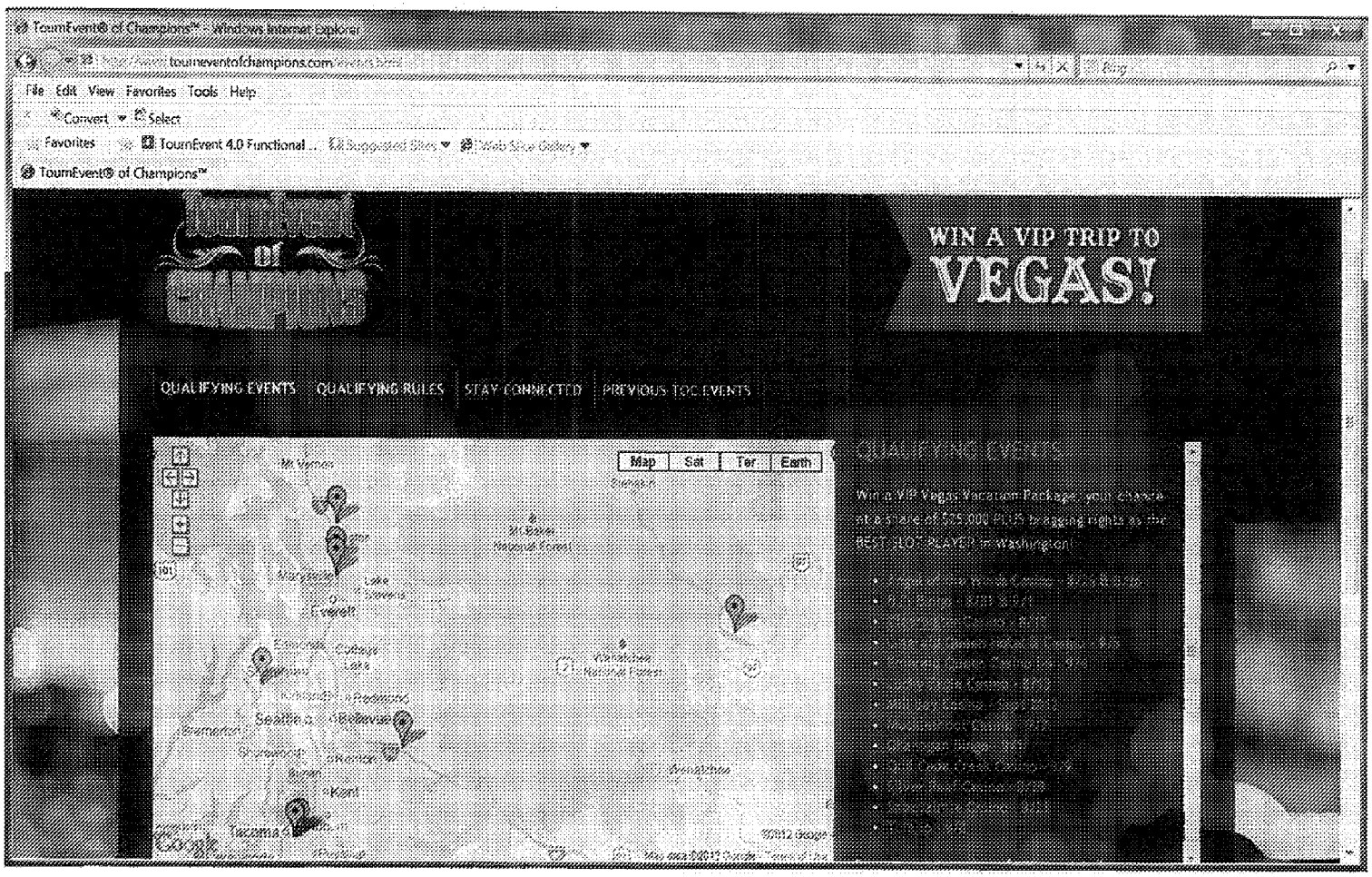
FIG. 6 is an example qualifying events webpage of a TournEvent of Champions (TEC) website wherein a viewer may access the published information concerning qualifying events at participating casino facilities.
Figure 7:
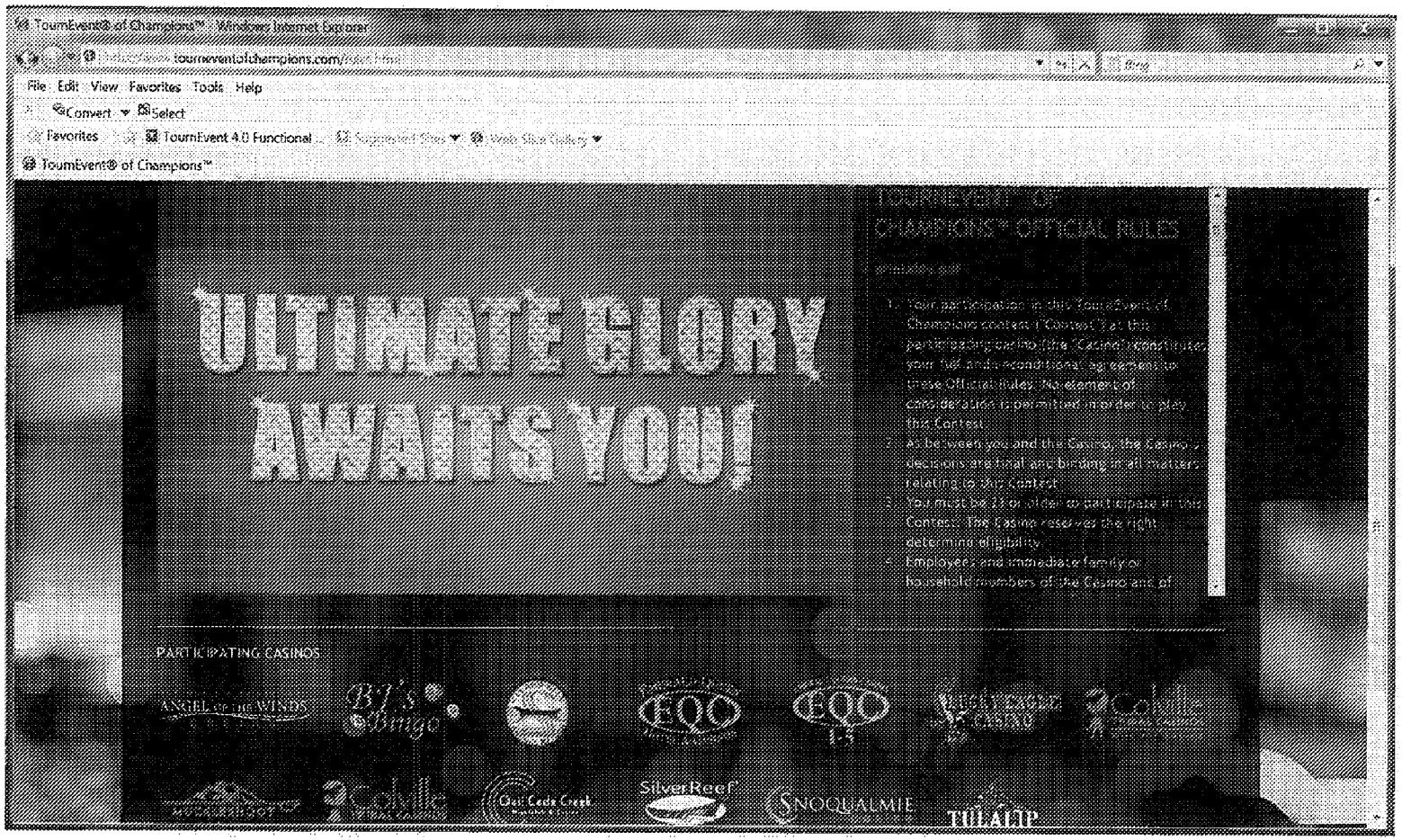
FIG. 7 is an example webpage of a TournEvent of Champions (TEC) website wherein a listing of the official rules may be found along with a listing of the participating casino facilities names and icons.
Figure 8:
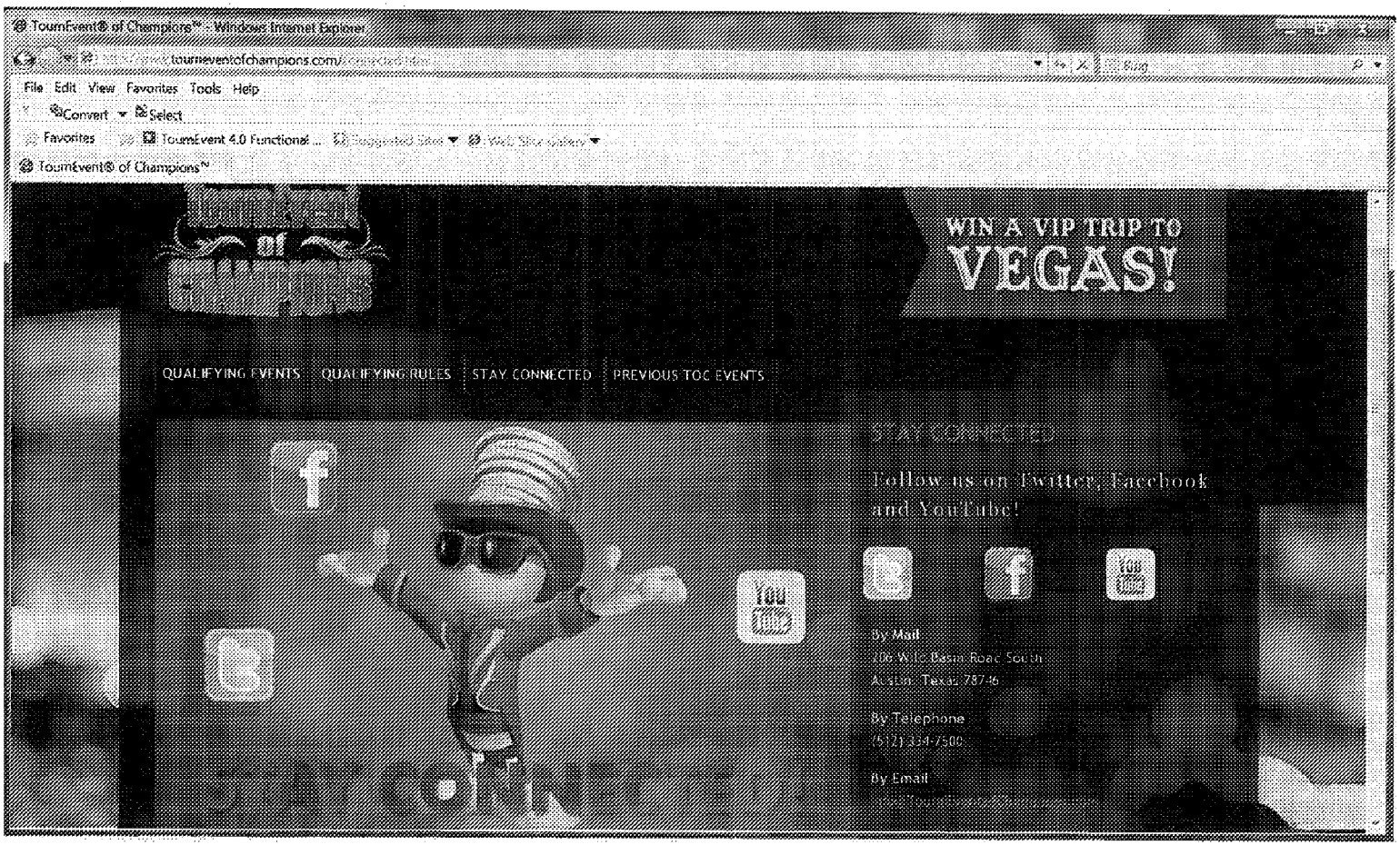
FIG. 8 is an example social media webpage of a TournEvent of Champions (TEC) website wherein a listing of various social media icons may be found for viewers to link and obtain various forms of data and media content associated with the TEC.
Figure 9:
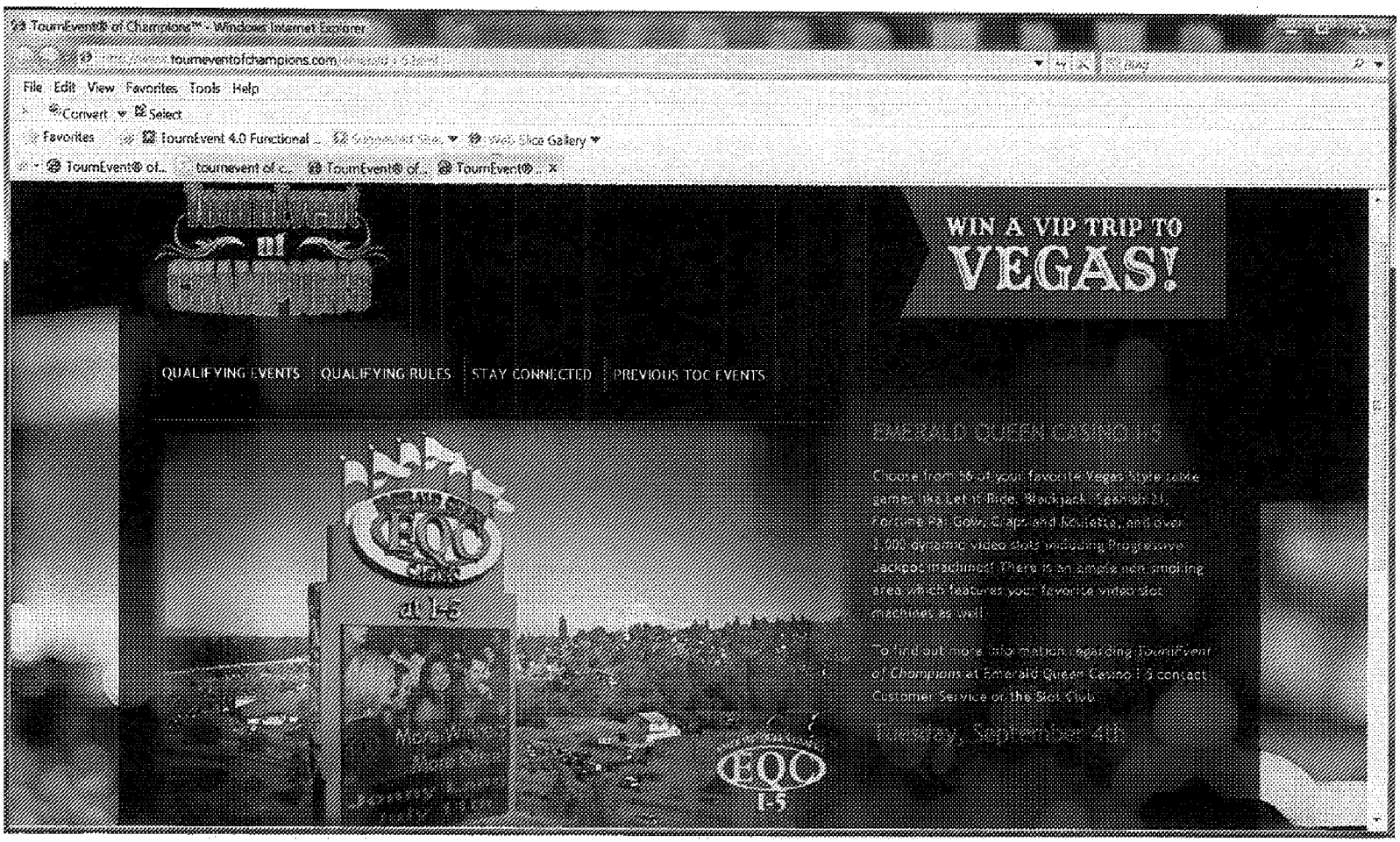
FIG. 9 is an example TEC webpage of a participating casino facility wherein a listing of the upcoming schedule for the facility may be found along with a menu through which a viewer may access the published information such as the qualifying events and rules associated with the TEC and the casino facility.

Once the TEC coordinator has received a listing of the in-casino winners, invitations may be transmitted through electronic or physical mail to provide the information for attending and participating in the TEC championship event which may include one or more tournament sessions to determine a TEC championship winner, step 113. Thereafter, each of the invited in-casino winners' names may be uploaded by the TEC coordinator into a database accessible by a TEC championship tournament server connected to designated gaming machines, step 117, and the TEC championship tournament may be operated in one or more tournament sessions on a tournament system (such as shown in FIGS. 3 and 4) to determine the TEC championship winner. During and after the event, information about the TEC championship tournament may be posted on the TEC webpages and social media site, step 119.

Figure 2:
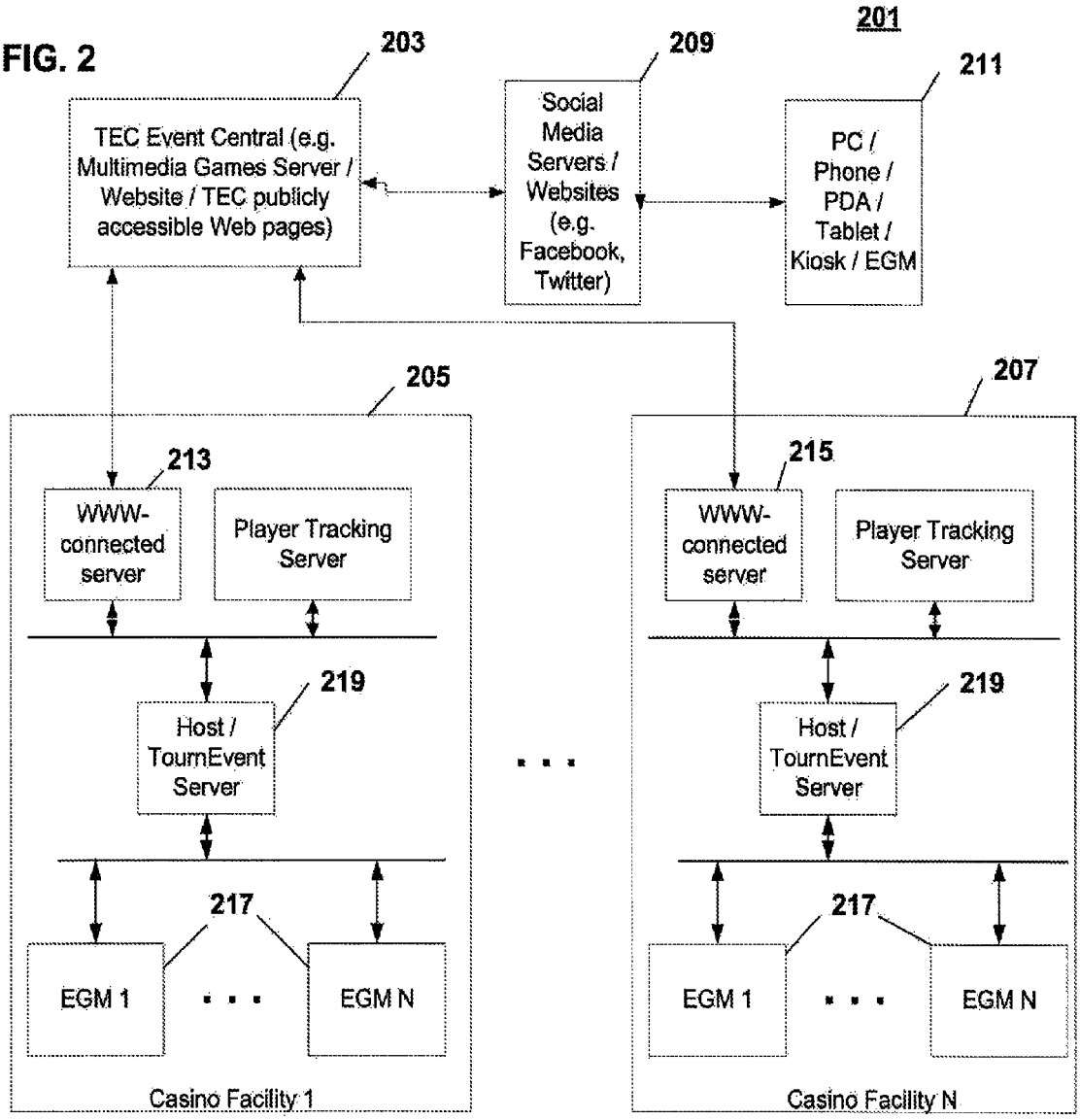
FIG. 2 illustrates an example multi-site tournament gaming system in accordance with one or more embodiments.

Referring to FIG. 2, example multi-site tournament gaming system 201 is shown in accordance with one or more embodiments. Multi-site tournament gaming system 201 may include TEC server & website 203 which may be bi-communicatively connected to two or more gaming facilities 205, 207 and one or more social media server & website 209.

Multi-site tournament gaming system 201 may additionally include and bi-communicatively connected to user interface devices 211 enabling users (e.g. players and the public-at-large) to access TEC published information and feeds. For example, user interface devices 211 may include without limitation personal computers, phones, personal data devices, tablets, kiosks, and gaming machines that may connect to one or more of gaming facility server and/or website 213, 215, social media server & website 209, and TEC server and website 203 to access information, recorded feeds, and/or live feeds published or transmitted by or to the various locations or facilities. For example, users may be able to download recorded feeds or receive live broadcasts of TEC pre-qualifying tournament sessions at various casino facilities 205, 207 or championship tournament sessions. Example live feeds may be directly transmitted (e.g. simulcast, podcast, RSS) from a tournament system server as in FIG. 3 or overhead display as in FIG. 4 whereon a real-time leaderboard may be displayed along with live player images and data. In addition to being able to monitor and view TEC information and feeds by accessing one of the websites or by downloading applications, user devices 211, such as phones, tablets, and personal computers, may be able to access one of the websites or download applications that also enable users to sign-up and/or play a tournament game simultaneously with one or more TEC pre-qualifying or championship tournament sessions, and in some cases to accumulate points, and awards, such as through TEC server and website 203 or facility server and website 213, 215. Users may also sign-up to receive emails, texts, etc. at various times so that they may receive the latest information about qualifying at various facilities, leaderboards, qualifying players, etc.

Further referring to FIG. 2, gaming facilities 205, 207 may include multiple gaming machines 217 connecting to tournament and/or host server 219, such that tournament and/or host server 219 may be configured to execute one or more TEC pre-qualifying and/or in-casino championship tournament sessions in conjunction with gaining machines 217. For the TEC championship tournament sessions, one of the participating gaming facilities 205, 207 or an entirely separate facility (e.g. a Carnival Cruise Line ship or a Las Vegas resort with an installed TournEvent gaming system) may be selected by the TEC coordinator. As part of the process for generating the listing of qualified players, the respective operators may utilize player tracking server 221 to track the play by various of its players to determine a portion of the qualified players, such as identifying those of its players with player tracking accounts and providing those meeting one or more criteria with an opportunity to register as qualified players; for example, highest rated (gold) players may receive an automatic invitation while others may have the opportunity to register for a drawing for various of the qualified player imitations, and still others may qualify by playing selected gaming machines and acquiring a threshold number of player points during a selected period.

With respect to the pre-qualifying events, the TEC coordinator may request that the participating gaming facilities respectively obtain a predetermined number or minimum number of qualified players by hosting specific events, such as by hosting weekly pre-qualifying tournaments for a period of several weeks or months, and selecting winners of various tournament sessions to be added to their database of qualified players. In some cases, the TEC coordinator may establish rules for generating the databases of qualified players or may provide for the participating facilities to determine their own criteria for generating their respective databases of qualified players and may offer some suggestions or guidelines. For example, the TEC coordinator may request that each participating facility generate a database of 300 qualified players to participate in the respective in-casino championship tournament sessions from which the in-casino champions are determined and each of which may receive one or more awards and an invitation to participate in the TEC championship tournament. By further example, to generate the database of qualified players, the TEC coordinator may request or require each participating facility to: a) host a series of pre-qualifying tournaments and/or host a series of events in order to determine 25-50% of the qualified players for the qualified player database; b) track player activity on one or more selected gaming machines in the facility, e.g. Multimedia Games gaming machines, and determine 25% of the qualified players based on play on those gaming machines; and c) select 25% of the qualified players from the facilities list of VIP players. Players may also participate in drawings at the respective facilities in order to qualify. Additionally, some facilities may issue a symbolic award, such as a golden ticket, to each qualifying player which may be required to be presented at the respective facility's in-casino championship tournament. Other facilities may offer consolation prizes, such as tee shirts or other mementos, to various players participating in the pre-qualifying and in-casino championship tournament sessions. In some instances, the in-casino championship tournament dates may be scheduled in coordination with the TEC coordinator, which may provide operational support to conduct the in-casino championship tournaments including providing hostesses and a mascot or symbolic master of ceremonies, such as Multimedia Games Moneyman, plus various prizes, awards, and keepsakes which may profile the facility name and logo, sponsors' names and logos, and/or the TEC name and logo. The in-casino championship winners may for example, receive a custom jersey and medal plus an invitation to participate in the TEC championship tournament with free accommodations, roundtrip airfare for themselves and a guest, and a cash prize (e.g. $1000). From each participating facility, one or more in-casino champions may be determined, such that the number of in-casino champions participating in the TEC championship tournament may be a predetermined number, such as 16 player-champions. As part of the TEC championship event, the TEC coordinator may host a welcome party, photo/video shoots and interviews with the participants including players, facility operators, and guests, which may be transmitted by live or delayed feed to the TEC, facility, and social media websites, and/or may be transmitted on an address or bandwidth which may be received by various user interface devices, such as phones, personal computers, etc. Apart from the TEC championship tournament, additional tournaments may be hosted for fun and/or awards and be made available for anyone to play, such as other guests of a hosting cruise line or resort where the TEC championship event is hosted. Various pre-events may be hosted to build up further anticipation and provide opportunities for the guests of the locale to participate and receive various keepsakes and prizes. As part of the TEC championship event, each of the in-casino champions names and possibly additional information such as their sponsoring facility and location, may be entered into the tournament server database and an operator may set up the tournament bank or banks with the respective player's name and any additional information displayed on respective of the gaming machines. To open the TEC championship event, the designated master of ceremonies, such as the Moneyman, may make an announcement that the TEC championship tournament is to begin and introduce the participating facility representatives and each of the in-casino champions; the Moneyman or one of the hostesses may then escort each of the players to the respective player's tournament gaming machine. The TEC champion may then be determined, for example, as being the top scorer from three two-minute round games and an award presentation may include an oversized check and a coordinated balloon and confetti drop.

Referring to FIGS. 3 and 4, example tournament game system 301 is shown with tournament server 219 controlling one or more tournament banks of gaming machines 217 which may be implemented and utilized as part of multi-site tournament gaming system 201, in accordance with one or more embodiments. In one or more embodiments, tournament server 219 may adjoin two banks of gaming machines 217; while in other embodiments tournament server 219 may be remote from the tournament banks. In some instances, the tournament banks may be convertible into an in-revenue mode when not used for tournaments; for example, as part of the pre-qualifying process, patrons may accumulate player points on the cons cited tournament banks during in-revenue mode operation and qualify by achieving a threshold number of points during a designated period of time or players may be randomly selected and be designated qualified players eligible to participate in the TEC in-casino championship tournament.

As shown in FIGS. 3 and 4 and discussed in more detail in the U.S. patent applications incorporated by reference in this application, tournament server 219 may have the names of players uploaded into its memory, such as from a qualified player database generated by the facility operator, and a tournament operator may utilize user interface 303 to designate the number of sessions for a given tournament, the names of the players to compete in each of the sessions, and the associated gaming machine for each player to play during the respective sessions. Each tournament may be conducted in several rounds, so that winners may progress into subsequent rounds until the desired number of winning players is achieved; for example a pre-qualifier tournament may have 64 initial players and 4 tournament banks of 4 gaming machines 217, so that the first round could have 4 sessions of 16 players, during each session the top four scoring players may progress, so round two would have 16 remaining players of which the facility operator may elect to offer the top 10 players an invitation as qualified players to compete in the TEC in-casino championship tournament for a chance to win an invitation to the multi-site TEC championship tournament.

As shown in FIG. 4, each tournament bank may include one or more overhead displays 401 connected to receive data and information from each gaming machine 217 and tournament server 219 including live camera feeds of competing players, spectators and leaderboard data for display on a real- or quasi-real-time basis. The feeds and content of overhead displays 401 may be simulcast, podcast, etc. so that viewers may watch the tournament action on phones, personal computers, gaming machines or other devices which may connect to the data stream and have applications executable to render the tournament data on each viewer's respective display device.

Referring to FIGS. 5-9 collectively, example webpages 501, 601, 701, 801, 901 are shown that may be published and displayed through the TEC or another server on the TEC website 203. Webpage 501 (FIG. 5) may be a home page that may list the upcoming schedule for a multi-site TEC tournament series of events and include a menu through which a viewer may access the published information, such as qualifying events (webpage 601, FIG. 6) for various participating casino facilities, qualifying finals dates and information, tournament participation rules and participating facilities (webpage 701, FIG. 7), connection information for social media, RSS feeds, etc. (social media webpage 801, FIG. 8), information about prior events. On the webpages, one or more may have active facility icons/buttons which when selected by a viewer may open a webpage (e.g., participating casino webpage 901, FIG. 9) specific to the facility and display pre-qualifying event information and dates for the in-casino championship tournament.

Additional webpages may be provided such as to enable enrollment by respective facilities into scheduled multi-site tournaments; for example, an enrollment page may include active fields where the enrolling facility may insert the facility name, location, and attach a logo for publishing. The enrollment page may include various menus enabling an enrolling facility to select available dates to conduct pre-qualifying and in-casino championship tournament events.

In one or more embodiments, social media page 801, or an alternate accessible location, such as one of the app stores of various mobile devices, may include downloadable applications for viewers to receive online audio, video, and/or data streams from various of the scheduled events. For example, social media webpage 801 may include a portal for receiving information from the enrolled facilities about scheduled pre-qualifying events; receiving captured images and data from pre-qualifying, events at respective of the enrolled facilities; receiving captured images and data from in-casino championship tournaments at respective of the enrolled facilities; publishing the schedules for the pre-qualifying events and locations; and, publishing selected of the captured images and data. In one or more embodiments, social media webpage 801 may be enabled to publish the captured images and data in real-time or quasi-real-time, wherein the captured images include audio and video signals. In one or more embodiments, social media webpage 801 may provide a gaming portal to viewers wherein viewers may download one or more gaming applications, receive a countdown transmission for an impending pre-qualifying tournament event, and participate remotely in the pre-qualifying tournament event or a pseudo-version of the pre-qualifying tournament event. In some instances, the viewers may actually qualify based on a posted score; and, in other instances, the viewers' participation may not qualify them but may receive the benefit of seeing their scores posted and possibly receive separate prizes through the TEC coordinator or enrolled facility for their participation.

Referring generally, to the forgoing description, as used herein the terms "comprising)," "including," "carrying," "having" "containing," "involving," and the like are to be understood to be open-ended, that is, to mean including but not limited to. Only the transitional phrases "consisting of" and "consisting essentially of," respectively, shall be considered exclusionary transitional phrases, as set forth, with respect to claims, in the United States Patent and Trademark Office Manual of Patent Examining Procedures. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term). The term 'presentation' as used herein is meant to refer to the display of any image and/or video performance and/or the performance of one or more sound bites or audio tracks (such as digital or analog sound tracks or information stored on a memory device and processed by an audio controller to emit sound through a speaker) whether in an attract mode or as part of a game presentation or outcome.

The above described example embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method of operating a multi-site tournament system including:

(a) receiving and storing information enrolling two or more gaming facilities into a multi-site tournament database in the multi-site tournament system;

(b) establishing a set of pre-qualifying events to generate a list of qualified players at each of the enrolled gaming facilities;

(c) scheduling one or more dates to conduct an in-casino championship tournament at each of the enrolled gaming facilities wherein the qualified players from the respective lists compete for one or more awards including an opportunity to advance to one or more multi-site tournaments;

(d) scheduling one or more dates and locations to conduct the one or more multi-site tournaments; and (e) uploading and publishing information about the multi-site tournament, pre-qualifying events, enrolled facilities, and qualified players to one or more social media portals so that the information about the multi-site tournament, pre-qualifying events, enrolled facilities, and qualified players is available to users of the one or more social media portals, including (i) receiving and storing information from the enrolled facilities about scheduled pre-qualifying events in the multi-site tournament database; (ii) receiving and storing captured images and data from pre-qualifying events at respective of the enrolled facilities in the multi-site tournament database; (iii) publishing the schedules for the pre-qualifying events and locations; and (iv) publishing selected of the captured images and data in real time or quasi-real time.

2. The method of claim 1 further including:

(a) transmitting an invitation to two or more selected facilities or their respective operators inviting their enrollment in the multi-site tournament;

(b) accepting information from respective ones of the enrolling facilities including one or more logos and one or more dates to conduct pre-qualifying events and the in-casino championship tournament, and adding that information to the multi-site tournament database; and (c) providing marketing materials to the enrolling facilities for publicizing the multi-site tournament.

3. The method of claim 1, the scheduling step for the in-casino championship tournaments including:

(a) coordinating dates of the respective in-casino championship tournaments to be completed on or before a selected date; and (b) scheduling marketing and administrative personnel to participate in conducting the respective in-casino championship tournaments.

4. The method of claim 1, the scheduling step for the one or more multi-site tournaments including:

(a) determining a date and place for the multi-site championship tournament;

(b) determining a pre-determined number of winners from each of the enrolled facilities to compete in the multi-site championship tournament; and (c) identifying and reserving the facilities for hosting the multi-site championship tournament.

5. The method of claim 4, the scheduling step for the one or more multi-site tournaments including identifying and negotiating travel and accommodation rates and dates for transporting and housing for one or more of the pre-determined number of winners, facility representatives, guests, and tournament support personnel.

6. The method of claim 1, the scheduling step for the one or more multi-site tournaments including:

(a) determining the dates and places for the first tier of multi-site tournaments;

(b) determining a pre-determined number of winners from each of the enrolled facilities to compete in at least one of the first tier of multi-site tournaments, wherein a pre-determined number of first tier winners advance to a next tier of multi-site tournaments; and (c) identifying and reserving the facilities for hosting the first tier of multi-site tournaments.

7. The method of claim 6, the scheduling step for the one or more multi-site tournaments including identifying and negotiating travel and accommodation rates and dates for transporting and housing the pre-determined number of winners, facility representatives, guests, and tournament support personnel.

8. The method of claim 6, the scheduling step for the one or more multi-site tournaments including:

(a) determining the pre-determined number of first tier winners to compete in a next tier of multi-site tournaments, wherein the next tier comprises a championship tier; and (b) identifying and reserving the facilities for hosting the championship tournament.

9. The method of claim 8, the scheduling step for the one or more multi-site tournaments including identifying and negotiating travel and accommodation rates and dates for transporting and housing the pre-determined number of first tier winners, facility representatives, guests, and tournament support personnel.

10. The method of claim 1 wherein the captured images include audio and video signals.

11. The method of claim 1 further including the step of:

(a) providing a gaming portal to viewers wherein viewers may download one or more gaming applications, receive a countdown transmission for an impending pre-qualifying tournament event, and participate remotely in the pre-qualifying tournament event or a pseudo-version of the pre-qualifying tournament event.

12. The method of claim 11 further including the step of:

(a) publishing the scores of in-casino and remote participants in the pre-qualifying tournament event.

13. A multi-site tournament gaming system including:

(a) two or more gaming facility subsystems, each gaming facility subsystem including a facility tournament system operative to conduct one or more tournaments and determine one or more facility winners;

(b) a tournament coordinator server communicatively connecting to the two or more gaming facility subsystems to receive tournament data and information concerning facility winners;

(c) a multi-site tournament system operative to receive the names of facility winners and conduct one or more tournaments with the facility winners to determine one or more multi-site winners;

(d) one or more websites communicatively connecting through respective website servers to one or more of the tournament coordinator server, the multi-site tournament system, and the gaming facility subsystems, the website servers receiving and publishing tournament data and information for viewing by persons accessing the respective websites; and (e) one or more of the respective website servers configured to receive and publish the tournament data and information substantially in real-time, the tournament data including at least one of audio and video data streams from one or more of the gaming facility subsystems, tournament coordinator server, and multi-site tournament system.

14. The system of claim 13, in which the tournament coordinator server is operative to connect to one or more external social media servers and websites for transmitting tournament data for publication.

15. The system of claim 13, in which at least one of facility tournament systems further comprises one or more tournament banks of gaming machines, the tournament banks each including one or more overhead displays connected to receive data and information from each gaming machine and tournament server including live camera feeds of competing players, spectators and leaderboard data for display on a real- or quasi-real-time basis.

16. The system of claim 15, in which the tournament banks are convertible into an in-revenue mode when not used for tournaments.

* * * * *